US008006974B2

(12) United States Patent
Hsiao

(10) Patent No.: US 8,006,974 B2
(45) Date of Patent: Aug. 30, 2011

(54) PAPER FEEDING MODULE AND MULTI-FUNCTION PERIPHERAL HAVING THE SAME

(75) Inventor: Ren-Hung Hsiao, Taipei County (TW)

(73) Assignee: Cal-Comp Electronics & Communications Company Limited, New Taipei (TW)

( * ) Notice: Subject to any disclaimer, the term of this patent is extended or adjusted under 35 U.S.C. 154(b) by 25 days.

(21) Appl. No.: 12/505,542

(22) Filed: Jul. 20, 2009

(65) Prior Publication Data

US 2010/0237555 A1 Sep. 23, 2010

(30) Foreign Application Priority Data

Mar. 19, 2009 (TW) ..... 98204349 U

(51) Int. Cl.
*B65H 3/52* (2006.01)

(52) U.S. Cl. ..... 271/121

(58) Field of Classification Search ..... 271/121
See application file for complete search history.

(56) References Cited

U.S. PATENT DOCUMENTS 4,364,551 A * 12/1982 Rutishauser ..... 271/121
4,822,023 A * 4/1989 Miyoshi ..... 271/118
5,026,042 A * 6/1991 Miller ..... 271/119
5,052,676 A * 10/1991 Shiina et al. ..... 271/121
5,485,991 A * 1/1996 Hirano et al. ..... 271/121
5,520,381 A * 5/1996 Lo et al. ..... 271/117
5,895,040 A * 4/1999 Oleksa et al. ..... 271/124
5,951,003 A * 9/1999 Nojima et al. ..... 271/121
6,086,062 A * 7/2000 Nakamura et al. ..... 271/121
6,663,098 B2 * 12/2003 Teo et al. ..... 271/121
2004/0032076 A1 * 2/2004 Kawakami ..... 271/121

* cited by examiner

*Primary Examiner* — Stefanos Karmis
*Assistant Examiner* — Luis A Gonzalez
(74) *Attorney, Agent, or Firm* — Jianq Chyun IP Office

(57) ABSTRACT

A multi-function peripheral includes a main body and a paper feeding module. The paper feeding module includes a supporting base, a feeding element and a paper separating elastic element. The supporting base is disposed on the main body. The supporting base is suitable for supporting multiple paper sheets and defines a paper feeding path. The feeding element is disposed above the supporting base for feeding the paper sheets along the paper feeding path. The paper separating elastic element has a fixed end connected to the supporting base and a free end disposed on the paper feeding path. When the feeding element feeds the papers along the paper feeding path, the free end applies a frictional force on the paper sheets such that one paper sheet passes the paper separating element and keeps moving while the rest of the paper sheets are blocked from moving by the paper separating elastic element.

11 Claims, 8 Drawing Sheets

PAPER FEEDING MODULE AND MULTI-FUNCTION PERIPHERAL HAVING THE SAME

CROSS-REFERENCE TO RELATED APPLICATION

This application claims the priority benefit of Taiwan application serial no. 98204349, filed on Mar. 19, 2009. The entirety of the above-mentioned patent application is hereby incorporated by reference herein and made a part of specification.

BACKGROUND OF THE INVENTION

1. Field of the Invention

The present invention relates to a paper feeding module and a multi-function peripheral using the paper feeding module, and more particularly, to a paper feeding module with paper separation function and a multi-function peripheral using the paper feeding module.

2. Description of Related Art

In the informationized society, offices are typically equipped with automatic equipments such as a scanner, a photocopier or a printer. Users can perform various document processing operations through the use of these automatic equipments. If these automatic equipments are individually disposed in the office, they may occupy a considerable amount of space. Accordingly, a multi-function peripheral (MPF) which integrates the function of photocopying, printing and scanning has been developed to solve the foregoing problems.

Users often place a stack of paper sheets in a paper tray of the MPF for photocopying, printing or scanning. In order for the MPF to fetch a single paper sheet each time, the paper feeding module usually includes a paper separating member. A common separating member is a separation roller which separates the paper sheets by using the reverse rotations of the separation roller and a feeding roller. When more than two paper sheets are driven to move, the feeding roller drives the upmost paper sheet into the MPF while the separation roller pushes the rest of the paper sheets back into the paper tray thus achieving the paper separation. Speed matching between the feeding roller and the separation roller and precise clearance between the feeding roller and the separation roller are of critical importance. If the speeds are unmatched or the clearance is imprecise, paper sheets with different thickness or of different material could not be successfully separated.

SUMMARY OF THE INVENTION

Accordingly, the present invention is directed to a paper feeding module capable of effective paper separation.

The present invention is also directed to a multi-function peripheral which includes a paper feeding module capable of effective paper separation.

The present invention provides a paper feeding module suitable for a multi-function peripheral. The paper feeding module comprises a supporting base, a feeding element, and a paper separating elastic element. The supporting base is adapted to support a plurality of paper sheets and defines a paper feeding path. The feeding element is disposed above the supporting base for driving the paper sheets to move along the paper feeding path. The paper separating elastic element has a fixed end connected to the supporting base and a free end disposed on the paper feeding path. When the feeding element drives the paper sheets to move along the paper feeding path, the free end applies a frictional force on the paper sheets such that one of the paper sheets passes the paper separating elastic element and keeps moving while the rest of the paper sheets are blocked from moving by the paper separating elastic element.

The present invention provides a multi-function peripheral comprising a main body and a paper feeding module. The paper feeding module comprises a supporting base, a feeding element, and a paper separating elastic element. The supporting base is disposed on the main body. The supporting base is adapted to support a plurality of paper sheets and defines a paper feeding path. The feeding element is disposed on the main body and above the supporting base for driving the paper sheets to move along the paper feeding path. The paper separating elastic element has a fixed end connected to the supporting base and a free end disposed on the paper feeding path. When the feeding element drives the paper sheets to move along the paper feeding path, the free end applies a frictional force on the paper sheets such that one of the paper sheets passes the paper separating elastic element and keeps moving while the rest of the paper sheets are blocked from moving by the paper separating elastic element.

According to one embodiment of the present invention, the paper separating elastic element comprises a plurality of branches at the free end and these branches are sequentially arranged along the paper feeding path.

According to one embodiment of the present invention, the paper feeding module further comprises a position limiter having a plurality of leaning surfaces and disposed on the supporting base. Each leaning surface has a different angle of inclination, and the branches are leaned against the leaning surfaces, respectively, such that these branches are sequentially arranged along the paper feeding path.

According to one embodiment of the present invention, the paper separating elastic element comprises a plurality of sub-elastic elements, each sub-elastic element has a sub-fixed end connected to the supporting base and a sub-free end disposed on the paper feeding path, and the sub-fixed ends and the sub-free ends constitute the fixed end and the free end, respectively.

According to one embodiment of the present invention, the sub-elastic elements are sequentially arranged along the paper feeding path.

According to one embodiment of the present invention, the material of the paper separating elastic element is thermoplastic elastomer.

According to one embodiment of the present invention, the feeding element is a feeding roller.

According to one embodiment of the present invention, the multi-function peripheral further comprises a cover covering the paper feeding module.

In view of the foregoing, the paper feeding module of the multi-function peripheral of the present invention employs the paper separating elastic element to perform the paper separation. The paper separating elastic element has a simple design and is easy to configure. The paper separating elastic element may be configured with suitable material and size to effectively separate the paper sheets depending on the type of the multi-function peripheral and the paper sheets that are used.

In order to make the aforementioned and other features and advantages of the present invention more comprehensible, embodiments accompanied with figures are described in detail below.

DESCRIPTION OF THE EMBODIMENTS

Figure 1:
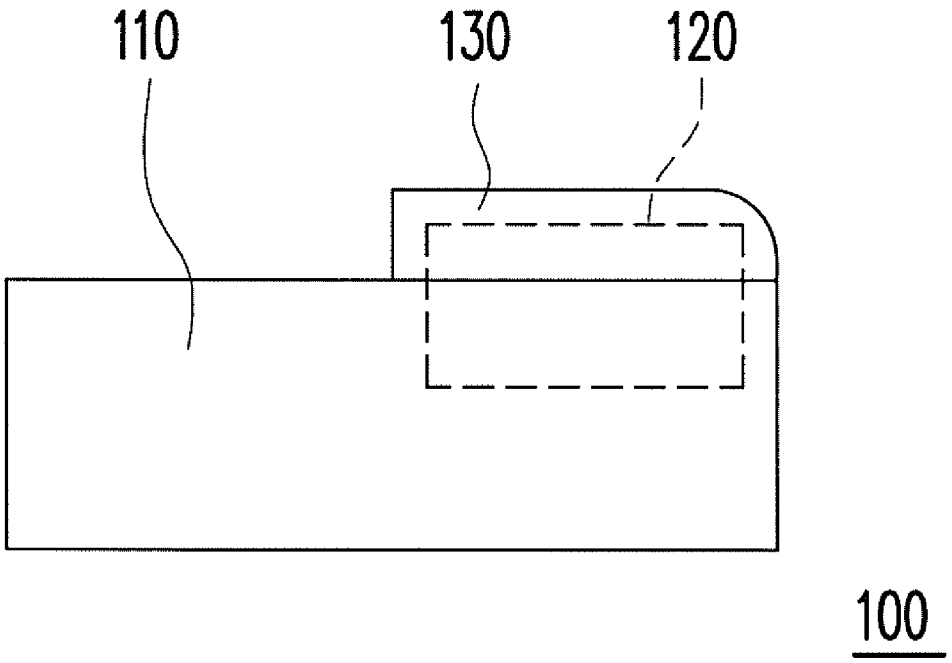
FIG. 1 is a side view of a multi-function peripheral according to one embodiment of the present invention.
Figure 2:
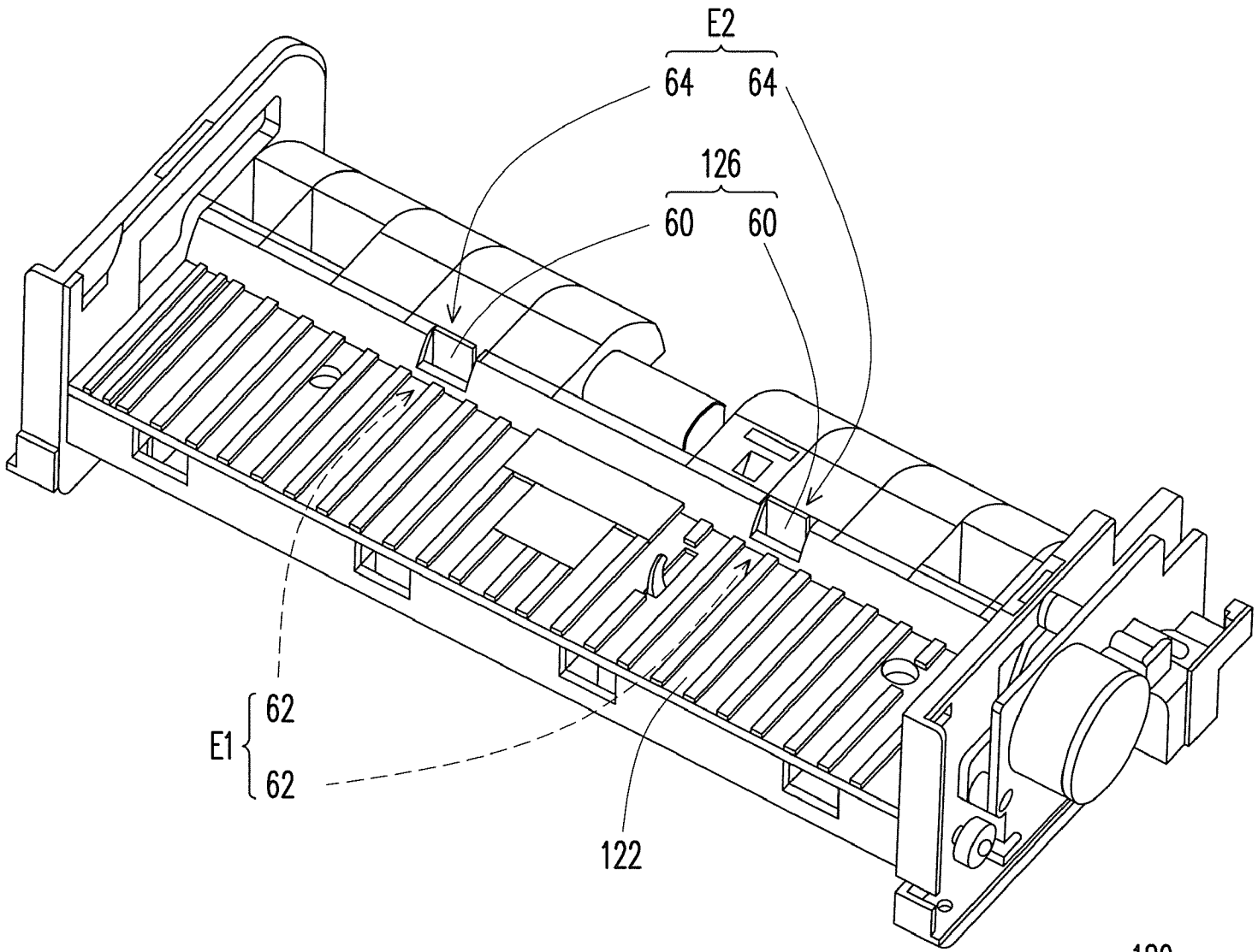
FIG. 2 is a partial, perspective view of the paper feeding module of FIG. 1.
Figure 3:
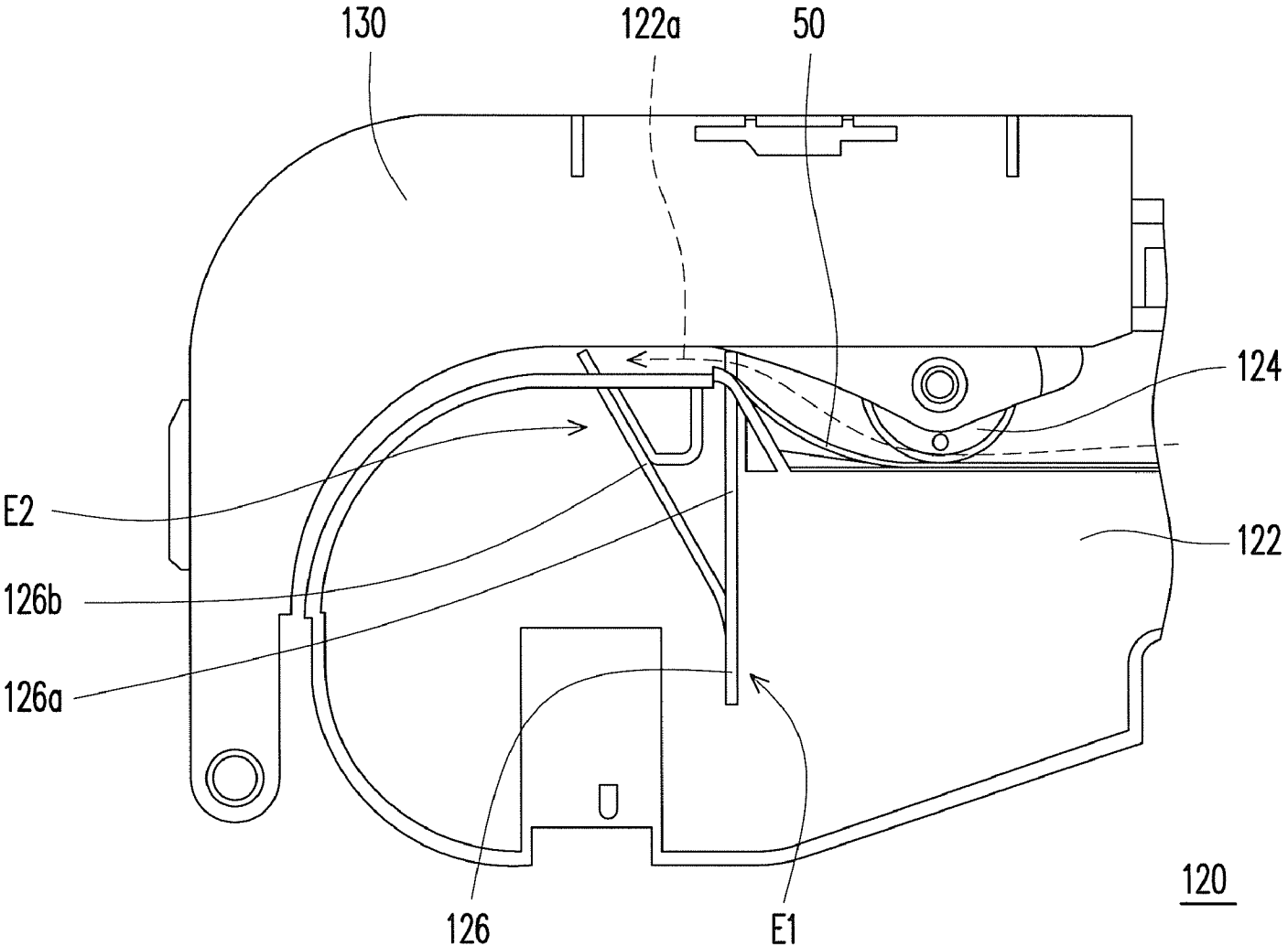
FIG. 3 is a partial, side view of the paper feeding module of FIG. 1.

FIG. 1 is a side view of a multi-function peripheral (MPF) according to one embodiment of the present invention. FIG. 2 is a partial, perspective view of the paper feeding module of FIG. 1. FIG. 3 is a partial, side view of the paper feeding module of FIG. 1. Referring to FIGS. 1 to 3, the MPF 100 includes a main body 110 and a paper feeding module 120. The paper feeding module 120 includes a supporting base 122, a feeding element 124, and a paper feeding elastic element 126. In the present embodiment, the feeding element 124 is, for example, a feeding roller. The MPF 100 further includes a cover 130 for covering the paper feeding module 120.

The supporting base 122 is disposed on the main body 110. Referring to FIG. 3, the supporting base 122 is used to support a plurality of paper sheets 50 and defines a paper feeding path 122*a*. The feeding element 124 is disposed on the main body 110 and above the supporting base 122, for driving the paper sheets 50 to move along the paper feeding path 122*a*. The paper separating elastic element 126 has a fixed end E1 connected to the supporting base and a free end E2 disposed on the paper feeding path 122*a*. When the feeding element 124 drives the paper sheets 50 to move along the paper feeding path 122*a*, the free end E2 applies a frictional force on the paper sheet 50 such that one of the paper sheets 50 passes the paper separating elastic element 126 and keeps moving while the rest of the paper sheets 50 are blocked from moving by the paper separating elastic element 126.

Figure 4A:
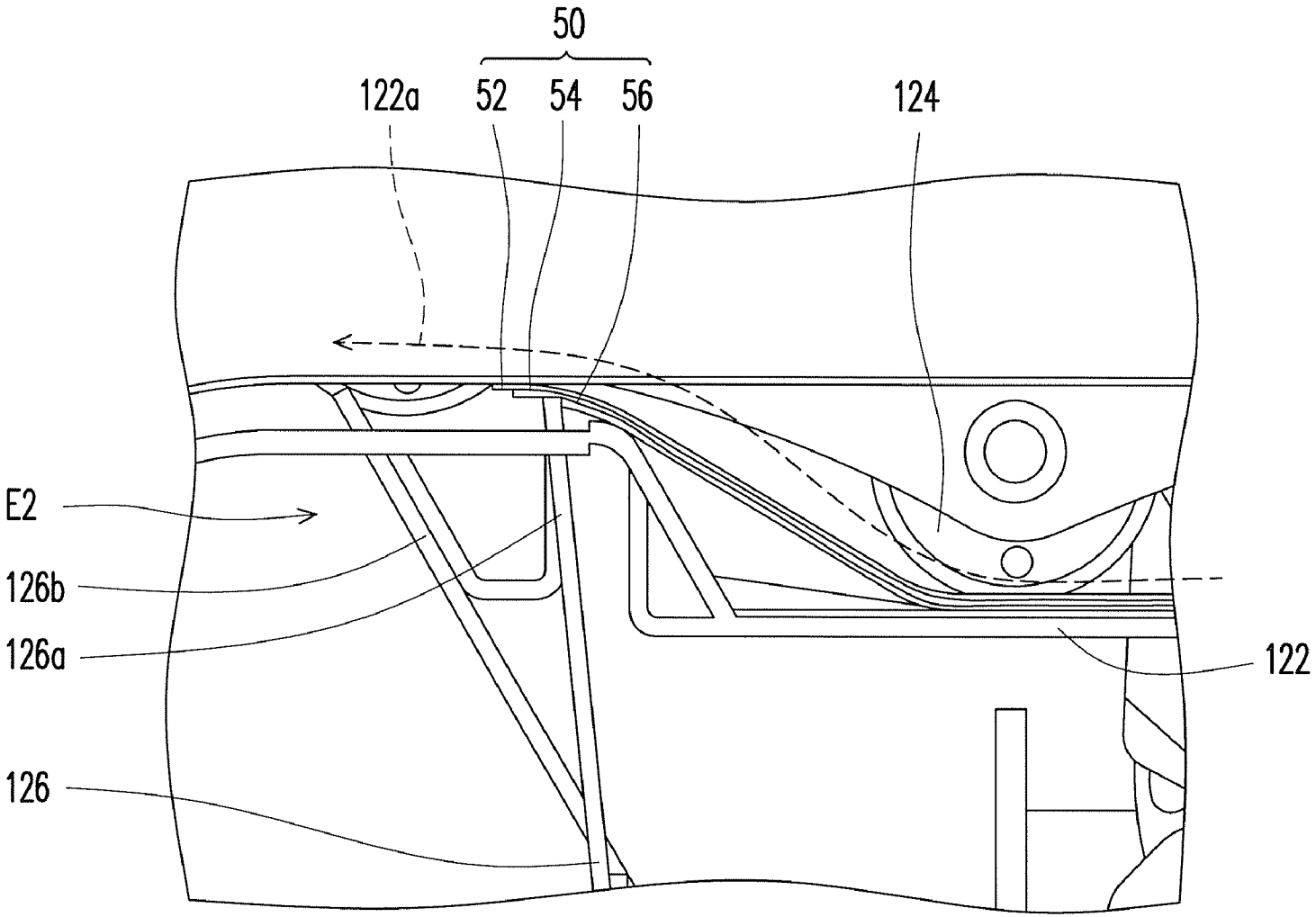
FIG. 4A and FIG. 4B illustrate operations of the paper feeding module of FIG. 1.
Figure 4B:
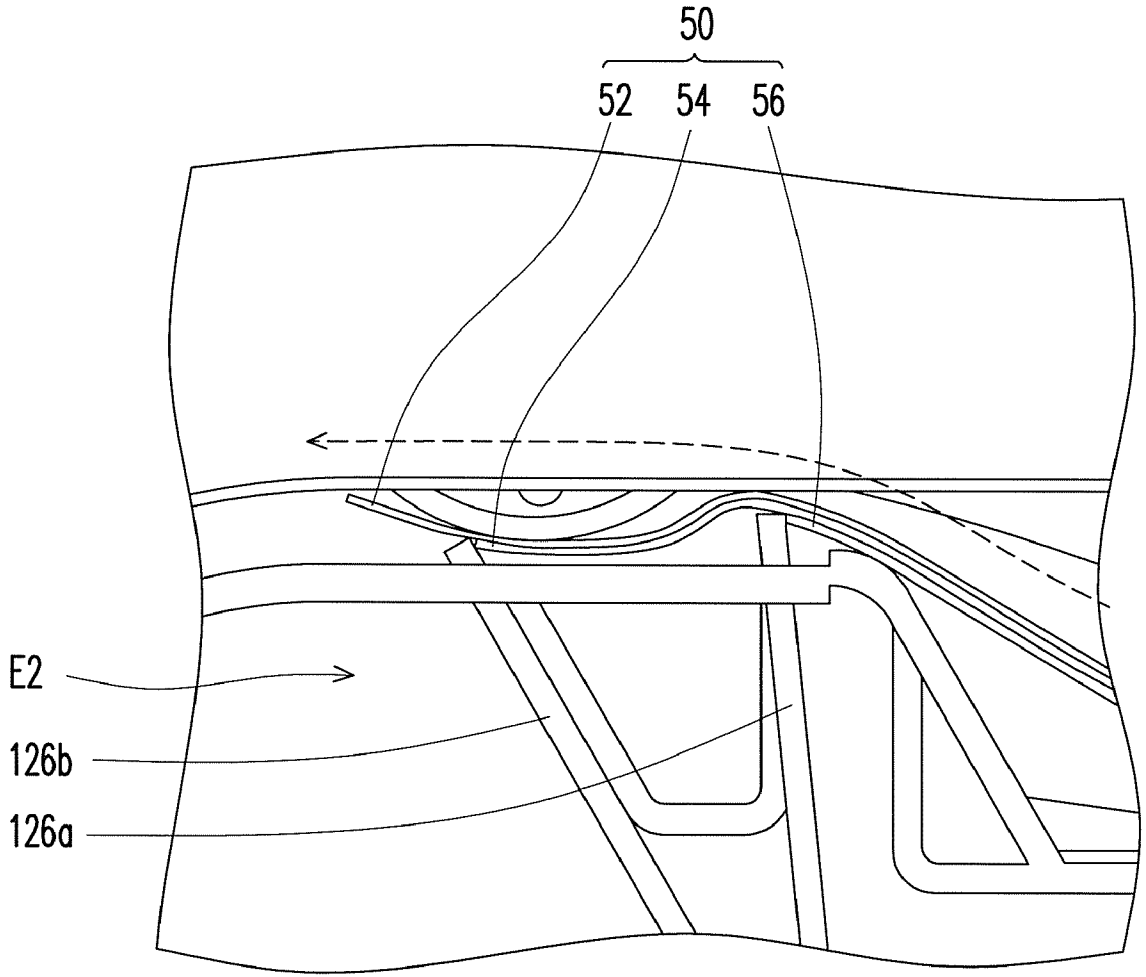

The paper separating process of the paper separating elastic element 126 of the present embodiment is described below in greater detail. FIG. 4A and FIG. 4B illustrate operations of the paper feeding module of FIG. 1. Referring to FIG. 4A, in the present embodiment, the paper separating elastic element 126 includes a plurality of branches 126*a* and 126*b* (two branches are illustrated) at the free end E2, and the branches 126*a* and 126*b* are sequentially arranged along the paper feeding path 122*a*. For example, the paper sheets 50 include a paper sheet 52, a paper sheet 54, and a paper sheet 56. As shown in FIG. 4A, the paper sheet 52, paper sheet 54 and paper sheet 56 move along the paper feeding path 122*a* under the driving of the feeding element 124 and the bottommost paper sheet 56 is blocked from moving by the branch 126*a* of the paper separating elastic element 126.

Referring now to FIG. 4B, the paper sheet 56 is blocked from moving, while the paper sheet 52 and paper sheet 54 move along the paper feeding path 122*a* under the driving of the feeding element 124. The paper sheet 54 is blocked from moving by the branch 126*b* of the paper separating elastic element 126. Finally, only the paper sheet 52 passes the paper separating elastic element 126 and keeps moving.

Figure 5:
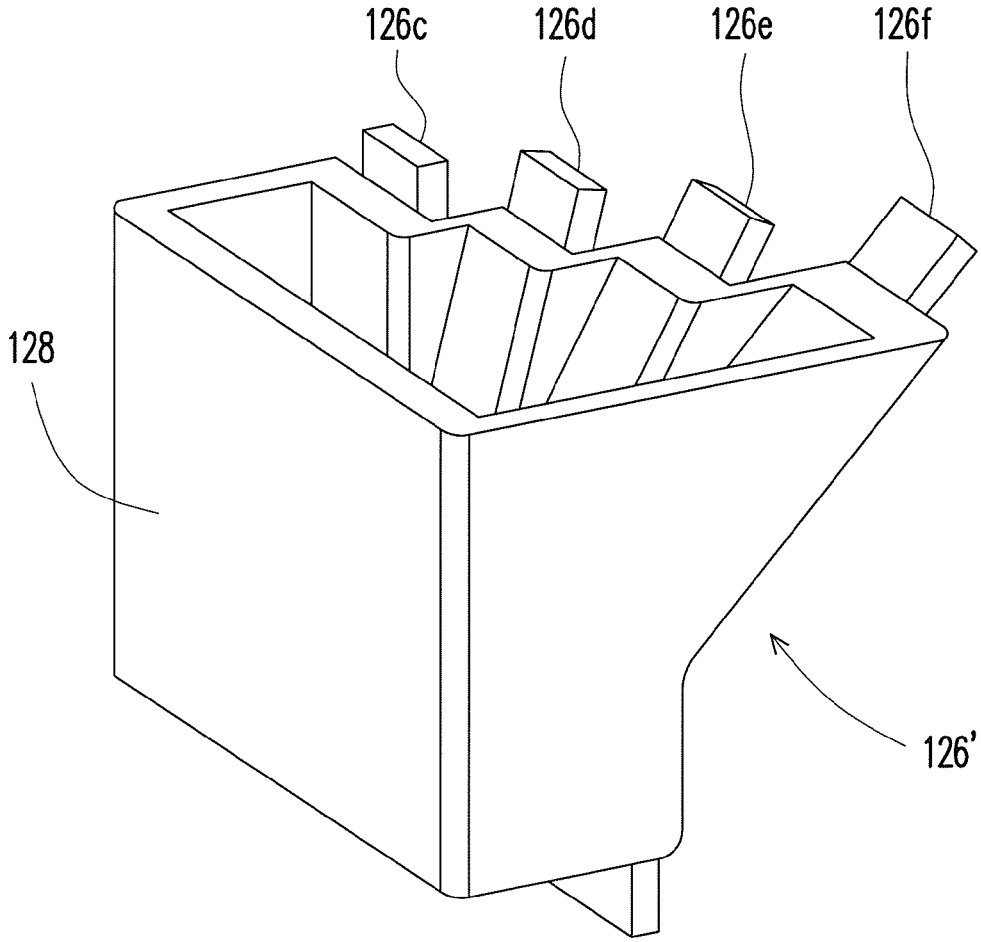
FIG. 5 is a partial, perspective view of the paper feeding module according to another embodiment of the present invention.
Figure 6:
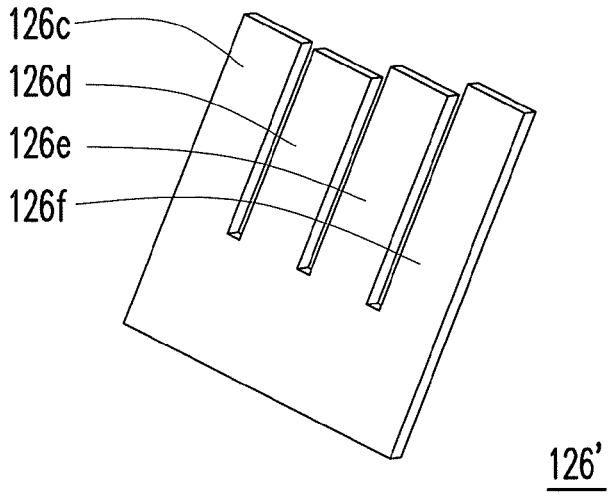
FIG. 6 is a perspective view of the paper separating elastic element of FIG. 5.
Figure 7:
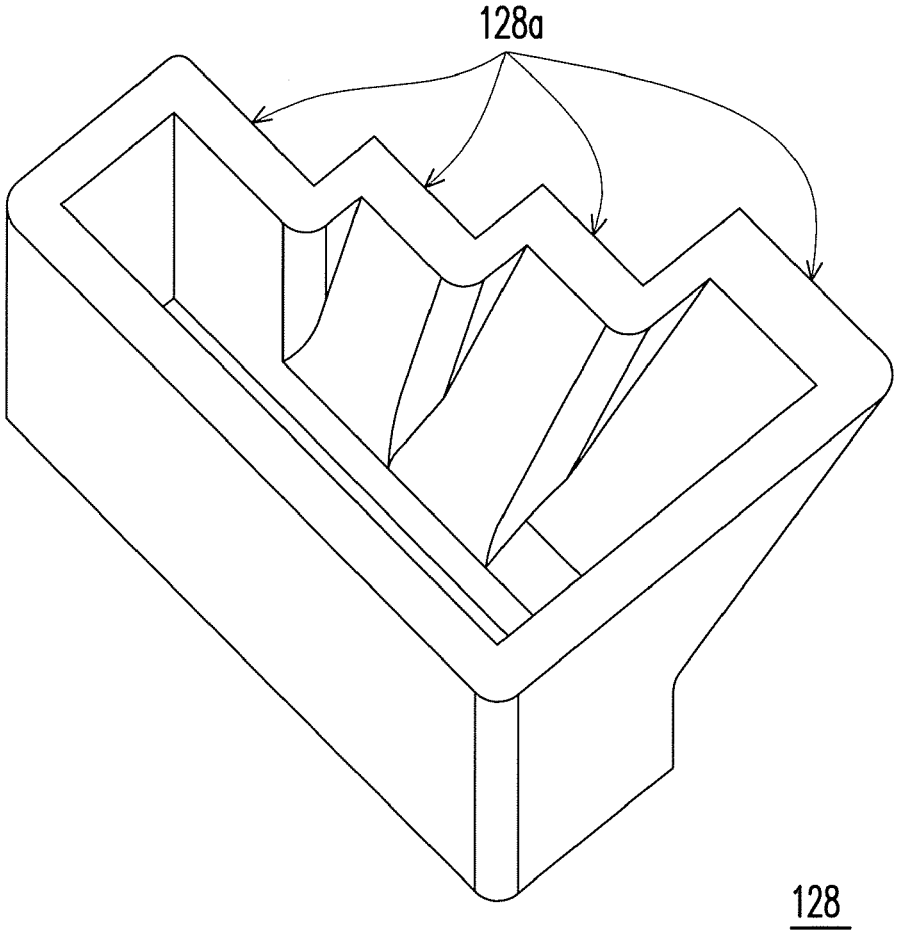
FIG. 7 is a perspective view of the position limiter of FIG. 5.
Figure 8:
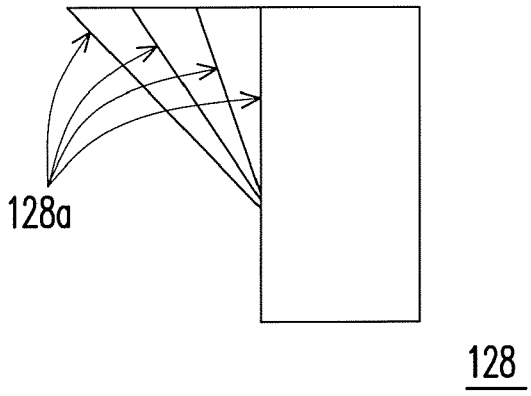
FIG. 8 is a side view of the position limiter of FIG. 5.

FIG. 5 is a partial, perspective view of the paper feeding module according to another embodiment of the present invention. FIG. 6 is a perspective view of the paper separating elastic element of FIG. 5. FIG. 7 is a perspective view of the position limiter of FIG. 5. FIG. 8 is a side view of the position limiter of FIG. 5. Referring to FIG. 5 to FIG. 8, when compared with the paper separating elastic element 126 of FIG. 3, the paper separating elastic element 126' of the present embodiment may include more branches 126*c*, 126*d*, 126*e* and 126*f* (four branches are illustrated). The paper feeding module of the present embodiment further includes a position limiter 128 having a plurality of leaning surfaces 128*a* and disposed on the supporting base (not shown). Each leaning surface 128*a* has a different angle of inclination. The branches 126*c*, 126*d*, 126*e* and 126*f* are leaned against the leaning surfaces 128*a*, respectively, such that these branches are sequentially arranged along the paper feeding path (not shown). It should be noted that the number and configuration of the branches of the paper separating elastic element may be determined based upon actual requirements and therefore the exemplary embodiments set forth herein should not be regarded as limiting.

Figure 9:
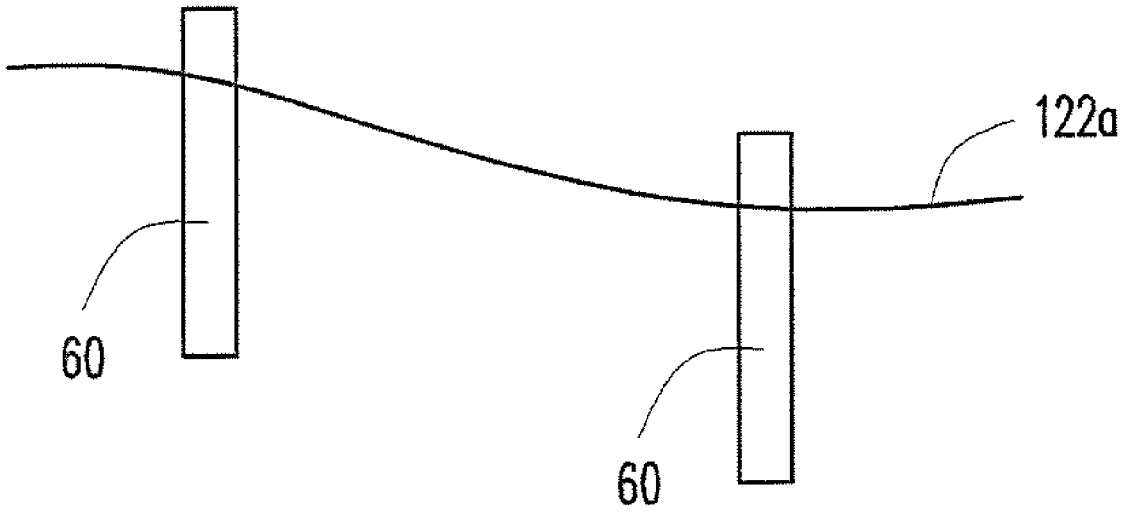
FIG. 9 is a partial view of the paper feeding module according to another embodiment of the invention.

Referring to FIG. 2, the paper separating elastic element 126 includes a plurality of sub-elastic elements 60. Each sub-elastic element 60 has a sub-fixed end 62 connected to the supporting base 122 and a sub-free end 64 disposed on the paper feeding path 122*a* (shown in FIG. 3). The sub-fixed ends 64 and the sub-free ends 62 constitute the fixed end E1 and the free end E2, respectively. In other words, a plurality of elastic elements may be symmetrically arranged on the supporting base 122 to make the force applied on the paper sheets uniform. FIG. 9 is a partial view of the paper feeding module according to another embodiment of the invention. In addition, according to FIG. 9, the sub-elastic elements 60 may further be sequentially arranged along the paper feeding path 122a to sequentially block different paper sheets from moving.

The material of the paper separating elastic element 126 is, for example, thermoplastic elastomer. It is noted, however, there is no limitation as to the material of the paper separating elastic element 126. Rather, the paper separating elastic element 126 may be made from any suitable elastic material.

In summary, the paper feeding module of the MPF of the present invention employs the paper separating elastic element to perform the paper separation. The paper separating elastic element has a simple design and is easy to configure. The paper separating elastic element may be configured with suitable material and size to effectively separate the paper sheets depending on the type of the MPF and the paper sheets that are used. In addition, the paper separating elastic element may include a plurality of branches for blocking different papers in sequence, such that the paper separation function is improved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A paper feeding module suitable for a multi-function peripheral, the paper feeding module comprising:

a supporting base adapted to support a plurality of paper sheets and defining a paper feeding path;

a feeding element disposed above the supporting base and adapted to drive the paper sheets to move along the paper feeding path;

a paper separating elastic element having a fixed end connected to the supporting base and a free end disposed on the paper feeding path, wherein when the feeding element drives the paper sheets to move along the paper feeding path, the free end applies a frictional force on the paper sheets such that one of the paper sheets passes the paper separating elastic element and keeps moving while the rest of the paper sheets are blocked from moving by the paper separating elastic element, wherein the paper separating elastic element comprises a plurality of branches at the free end and these branches are sequentially arranged along the paper feeding path; and a position limiter having a plurality of leaning surfaces and disposed on the supporting base, wherein each leaning surface has a different angle of inclination, and the branches are leaned against the leaning surfaces, respectively, such that these branches are sequentially arranged along the paper feeding path.

2. The paper feeding module according to claim 1, wherein the paper separating elastic element comprises a plurality of sub-elastic elements, each sub-elastic element has a sub-fixed end connected to the supporting base and a sub-free end disposed on the paper feeding path, and the sub-fixed ends and the sub-free ends constitute the fixed end and the free end, respectively.

3. The paper feeding module according to claim 2, wherein the sub-elastic elements are sequentially arranged along the paper feeding path.

4. The paper feeding module according to claim 1, wherein the material of the paper separating elastic element is thermoplastic elastomer.

5. The paper feeding module according to claim 1, wherein the feeding element is a feeding roller.

6. A multi-function peripheral comprising:

a main body; and a paper feeding module comprising:

a supporting base disposed on the main body, the supporting base adapted to support a plurality of paper sheets and defining a paper feeding path;

a feeding element disposed on the main body and above the supporting base and adapted to drive the paper sheets to move along the paper feeding path;

at least one paper separating elastic element having a fixed end connected to the supporting base and a free end disposed on the paper feeding path, wherein when the feeding element drives the paper sheets to move along the paper feeding path, the free end applies a frictional force on the paper sheets such that one of the paper sheets passes the paper separating elastic element and keeps moving while the rest of the paper sheets are blocked from moving by the paper separating elastic element, wherein the paper separating elastic element comprises a plurality of branches at the free end and these branches are sequentially arranged along the paper feeding path; and a position limiter having a plurality of leaning surfaces and disposed on the supporting base, each leaning surface has a different angle of inclination, and the branches are leaned against the leaning surfaces, respectively, such that these branches are sequentially arranged along the paper feeding path.

7. The multi-function peripheral according to claim 6, wherein the paper separating elastic element comprises a plurality of sub-elastic elements, each sub-elastic element has a sub-fixed end connected to the supporting base and a sub-free end disposed on the paper feeding path, and the sub-fixed ends and the sub-free ends constitute the fixed end and the free end, respectively.

8. The multi-function peripheral according to claim 7, wherein the sub-elastic elements are sequentially arranged along the paper feeding path.

9. The multi-function peripheral according to claim 6, wherein the material of the paper separating elastic element is thermoplastic elastomer.

10. The multi-function peripheral according to claim 6, wherein the feeding element is a feeding roller.

11. The multi-function peripheral according to claim 6, further comprising a cover covering the paper feeding module.

* * * * *